US007786945B2

(12) United States Patent
Baldauf et al.

(10) Patent No.: US 7,786,945 B2
(45) Date of Patent: Aug. 31, 2010

(54) BEAM WAVEGUIDE INCLUDING MIZUGUCHI CONDITION REFLECTOR SETS

(75) Inventors: John E. Baldauf, Redondo Beach, CA (US); Christ P. Tzelepis, Redondo Beach, CA (US); Paul C. Werntz, Long Beach, CA (US); Tom M. Hikido, Torrance, CA (US)

(73) Assignee: The Boeing Company, Chicago, IL (US)

( * ) Notice: Subject to any disclaimer, the term of this patent is extended or adjusted under 35 U.S.C. 154(b) by 537 days.

(21) Appl. No.: 11/678,651

(22) Filed: Feb. 26, 2007

(65) Prior Publication Data

US 2008/0204341 A1 Aug. 28, 2008

(51) Int. Cl.
*H01Q 13/00* (2006.01)
*H01Q 3/00* (2006.01)
*H01Q 3/12* (2006.01)

(52) U.S. Cl. ..... 343/781 P; 343/757; 343/761; 343/762

(58) Field of Classification Search ..... 343/878, 343/879, 880, 882, 772, 781 R, 781 P, 781 CA, 343/757, 761, 762; 342/359
See application file for complete search history.

(56) References Cited

U.S. PATENT DOCUMENTS 4,062,018 A * 12/1977 Yokoi et al. ..... 343/754
4,186,402 A * 1/1980 Mizusawa et al. ..... 343/781 CA
4,516,128 A * 5/1985 Watanabe et al. ..... 343/761
4,525,719 A * 6/1985 Sato et al. ..... 343/761
5,673,057 A * 9/1997 Toland et al. ..... 343/761
6,215,452 B1 * 4/2001 Chandler et al. ..... 343/781 P
6,342,865 B1 * 1/2002 Chandler et al. ..... 343/781 CA
6,492,955 B1 * 12/2002 Amyotte et al. ..... 343/781 P

OTHER PUBLICATIONS

Mizugutch, Y., Akagawa, M. and Yokoi, H., Offset Dual Reflector Antenna, Kokusai Denshin Denwa Co., Ltd, Tokyo, Japan, Tuesday, Oct. 12, pp. 2-5.
Brown, Kenneth W. and Prata, Aluizio, Jr., A Design Procedure for Classical Offset Dual Reflector Antennas With Circular Apertures, IEEE, Transactions on Antennas and Propagation, vol. 42, No. 8, Aug. 1994, pp. 1145-1153.
Chang, Seunghyuk and Prata, Aluizio, Jr., The Design of Classical Offset Dragonian Reflector Antennas With Circular Apertures, IEEE, Transactions on Antennas and Propagation, vol. 52, No. 1, Jan. 2004, pp. 12-19.

* cited by examiner

*Primary Examiner*—Hoang V Nguyen
*Assistant Examiner*—Robert Karacsony
(74) *Attorney, Agent, or Firm*—Charles L. Moore; Moore & Van Allen, PLLC

(57) ABSTRACT

A beam waveguide may include a first set of dual offset reflectors and a second set of dual offset reflectors. The first set of dual offset reflectors and the second set of dual offset reflectors may each include reflector geometries to produce a radiation pattern that is symmetric about a first axis between the first and second set of dual offset reflectors and to produce an axi-symmetric beam from the second set of dual offset reflectors that is unaffected by any rotation of the first and second set of dual offset reflectors relative to one another about the first axis.

24 Claims, 3 Drawing Sheets

BEAM WAVEGUIDE INCLUDING MIZUGUCHI CONDITION REFLECTOR SETS

BACKGROUND OF THE INVENTION

The present invention relates to waveguides, antennas and similar devices, and more particularly to a beam waveguide including a pair of dual offset reflector sets that satisfy the Mizuguchi condition and that may be associated with an antenna to send and receive signals.

Satellite systems often require a high gain antenna such as a reflector antenna with a large aperture size to provide high data rate communications either between the satellite and a fixed location on the earth, such as a ground station, or between the satellite and a mobile user with a small, low gain terminal. Realizing such high gain antennas is often a complex interaction between competing needs associated with the spacecraft. For example, blockages by solar panels and other structures associated with the spacecraft, or other antennas should be avoided while mass and complexity are also minimized. In addition, the payload for the high gain antenna may require high power and low losses on the signal path to the aperture of the antenna. One approach is to put the payload for the antenna into a pallet immediately behind the antenna and deploy the entire antenna/payload assembly away from the spacecraft. However, the palletized system may present a large increase in mass and complexity because of the need for separate thermal control and shielding for the pallet and the spacecraft bus. Additional pallet complexity arises due to the need to transmit signals to and from the pallet at some intermediate frequency (IF) if there is a substantial distance between the spacecraft and the pallet. Another issue may be increased complexity in controlling the spacecraft attitude when large masses are moved in a palletized system.

Another approach may be to use a beam waveguide similar that illustrated in FIGS. 1A, 1B, 2A and 2B, respectively. FIGS. 1A and 1B are an illustration of a prior art antenna system 100 including a moveable beam waveguide structure 102 and antenna assembly 104. FIGS. 1A and 1B illustrate the antenna assembly 104 in different rotational positions. As illustrated in FIG. 1B a portion of the structure interferes with a complete range of motion or field of regard of the antenna assembly 104. FIG. 2A is an illustration of a prior art antenna system 200 including a beam waveguide 202 including a set of offset paraboloid reflectors 204 and 206. The beam waveguide 202 may be the same as the waveguide 102 of FIGS. 1A and 1B. FIG. 2B is an adaptation of the prior art antenna system 200 of FIG. 2A illustrating the set of offset paraboloid reflectors 204 and 206 rotated relative to one another as described below.

Some satellite systems require a high gain antenna with a wide angular range of motion or field of regard. In these systems, conventional beam waveguides may be used to enhance the stability of the spacecraft as the antenna moves and to reduce the overall mass of the spacecraft, but achieving a substantially complete field of regard may be difficult due to several factors. Conventional beam waveguides typically have two axes of rotation. These axes are rotated using what may be referred to as an inner gimbal 106 and an outer gimbal 108 (FIGS. 1A and 1B). The outer gimbal 108 may be rigidly tied to the bus of the spacecraft and the inner gimbal 106 may ride the structure that is rotated by the outer gimbal 108. When the inner gimbal 106 rotates such that the main beam of the antenna is nearly parallel to the axis of the outer gimbal 108, the torque required to meet the scan velocity requirements is very high, resulting in regions in the field of regard that cannot be addressed by the antenna. This region of the field of regard may be referred to as the "keyhole." Another factor is that conventional beam waveguides such as that shown in FIGS. 1A and 1B have a rigid structure that holds two parabolic mirrors, similar to parabolic mirrors 208 and 210 in FIGS. 2A and 2B. As described in more detail below, to avoid distortions and loss of antenna efficiency and power, no rotations should occur between these mirrors. Therefore, the beam waveguide 202 is typically only rotated around mirror axes 212 and 214 in FIGS. 2A and 2B to minimize losses and to reduce the overall mass that is moved when the antenna is re-pointed. The restrictions on rotation or gimbaling around these mirrors makes achieving a wide field of regard difficult, because the antenna will rotate until the reflector hits the support structure 102 for the beam waveguide as illustrated in FIGS. 1A and 1B.

The restriction of no rotations between the parabolic mirrors 208 and 210 is due to the offset nature of the dual sets of paraboloids reflectors 204 and 206 in the beam waveguide 202 (FIGS. 2A and 2B). The configuration of the antenna system 200' in FIG. 2B or similar rotations between reflectors 208 and 210 that produce geometries other than that of FIG. 2A are precluded. The paraboloids 204 serve to receive the feed radiation, beam or wave from the feed horn 216, and collimate the beam or wave so it can transmit loss-free from between paraboloid reflectors 208 and 210, and re-create a spherical wave or beam from the feed horn 216 at a point or focus 218 of the antenna assembly 220. The offset paraboloid set 204 generates a beam that has a coherent, planar phase front between paraboloid reflectors 208 and 210, but has an asymmetrical field distribution around an axis 222 between the paraboloid reflectors 208 and 210. If paraboloid reflector 208 has an identical geometry to paraboloid reflector 210 and is aligned therewith, the wave reflecting from paraboloid reflector 208 will re-create the spherical wave pattern from the feed horn 216 at the focal point 218 of the antenna assembly 220 because the offset-induced field distortions will cancel out. If the paraboloid reflectors 208 and 210 are not identical or are rotated as shown in FIG. 2B relative to FIG. 2A, the field pattern at focal point 218 will not be identical to the feed pattern from feed horn 216. Such distortions as a function of the rotation angle about the axis 222 between paraboloid reflectors 208 and 210 will cause a loss in antenna efficiency and may preclude auto-tracking of the beam of the antenna 220. The ability to auto-track the beam is a desired feature of high gain, narrow beam systems. Therefore, to avoid distortions and loss of antenna efficiency, no rotations between the paraboloids 208 and 210 may be permitted.

BRIEF SUMMARY OF THE INVENTION

In accordance with an embodiment of the present invention, a beam waveguide may include a first set of dual offset reflectors and a second set of dual offset reflectors. The first set of dual offset reflectors and the second set of dual offset reflectors may each include reflector geometries to produce a radiation pattern that is symmetric about a first axis between the first and second set of dual offset reflectors and to produce an axi-symmetric beam from the second set of dual offset reflectors that is unaffected by any rotation of the first and second set of dual offset reflectors relative to one another about the first axis.

In accordance with another embodiment of the present invention, a beam waveguide may include a first set of reflectors for receiving a spherical wave and collimating the wave axi-symmetrically about a first axis. The beam waveguide may also include a second set of reflectors for receiving the axi-symmetric collimated wave transmitted along the first axis from the first set of reflectors. The second set of reflectors may be adapted to convert the collimated wave back to an axi-symmetric spherical wave axi-symmetric about a second axis. At least one reflector may be provided for receiving the axi-symmetric spherical wave along the second axis and for directing the spherical wave to converge at a focus of a reflector antenna system.

In accordance with another embodiment of the present invention, an antenna system may include an antenna for transmitting an output wave and a feed horn. The antenna system may include a first set of reflectors for receiving and converting a spherical wave from the feed horn to a collimated wave. A second set of reflectors may receive the collimated wave along a first axis from the first set of reflectors and may convert the collimated wave to another spherical wave for transmission to the antenna. At least one of the first and second set of reflectors may be rotatable about the first axis and include reflector components to permit rotation about the first axis without affecting the output wave from the antenna.

In accordance with another embodiment of the present invention, a method to provide a substantially complete field of regard in a beam waveguide without distortion in an output beam may include producing a collimated wave from a spherical wave for transmission along a first axis, wherein the collimated wave is axi-symmetric to the first axis. The method may also include producing an axi-symmetric spherical wave from the collimated axi-symmetric wave for transmission along a second axis. The collimated wave may remain axi-symmetrical and distortionless regardless of any rotation of reflector elements about the first and second axes.

Other aspects and features of the present invention, as defined solely by the claims, will become apparent to those ordinarily skilled in the art upon review of the following non-limited detailed description of the invention in conjunction with the accompanying figures.

DETAILED DESCRIPTION OF THE INVENTION

The following detailed description of embodiments refers to the accompanying drawings, which illustrate specific embodiments of the invention. Other embodiments having different structures and operations do not depart from the scope of the present invention.

Figure 3:
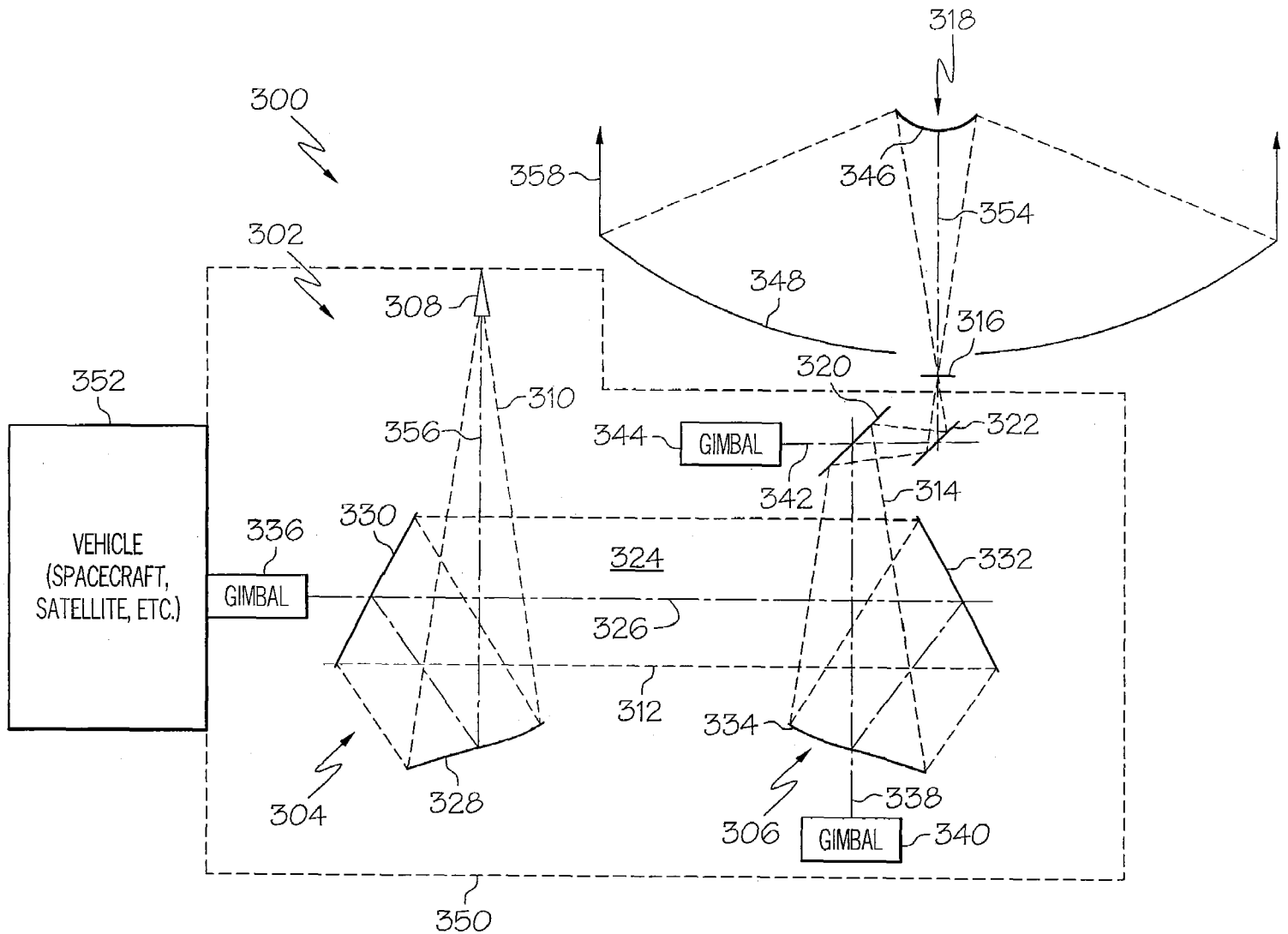
FIG. 3 is an illustration of an exemplary antenna system including a beam waveguide which includes a pair of dual offset reflector sets that satisfy the Mizuguchi condition in accordance with an embodiment of the present invention.

FIG. 3 is an illustration of an exemplary antenna system 300 including a beam waveguide 302 which includes a pair of dual offset reflector sets 304 and 306 that satisfy the Mizuguchi condition in accordance with an embodiment of the present invention. The system 300 may include a feed horn 308 that may radiate an electromagnetic or radio signal, beam or wave in the form of a spherical beam or wave 310 to the first set of dual offset reflectors 304 which collimates the beam 310. The collimated beam 312 then propagates to the second set of dual offset reflectors 306, which converts the beam back to a spherical wave 314, converging to a focus at a point 316, which may be the focus of a high gain reflector system 318, antenna assembly or other system capable of sending and receiving electromagnetic or radio signals. The high gain reflector system 318 may be a high gain Cassegrain antenna system. One or more flat reflectors 320 and 322 may be used to re-direct the beam 314 to the focus 316 without impacting beam waveguide performance, provided that the location of the feed image and direction of the feed image radiation is unchanged with respect to the high gain Cassegrain antenna system 318, reflectors 346 and 348. The reflectors 320 and 322 may be flat reflectors. Similarly to reflectors 320 and 322, one or more reflectors may be used to re-direct the beam 310 to the reflector set 304 without impacting the beam waveguide performance. These reflectors are not illustrated in FIG. 3 for purposes of simplicity.

The first and second set of dual offset reflectors 304 and 306 may each include reflectors with reflector geometries to produce a radiation pattern 324 that is symmetric about a first axis 326 between the first and second set of dual offset reflectors 304 and 306 and to produce the spherical beam 314 or wave from the second set of dual offset reflectors 306 that is axi-symmetric about a second axis 338 and unaffected by any rotation of the first and second set of dual offset reflectors 304 and 306 relative to one another about the first axis 326.

The first set of dual offset reflectors 304 may include a hyperboloid reflector 328 to receive the spherical wave 310 from the feed horn 308. The first set of dual offset reflector 304 may also include a paraboloid reflector 330 to transmit the axi-symmetric collimated wave 312 or beam to the second set of dual offset reflectors 306 along the first axis 326. The axi-symmetric collimated beam is axi-symmetrical about the first axis 326, as a result of the geometries of the reflectors 328 and 330.

The second set of dual offset reflectors 306 may include a paraboloid reflector 332 to receive the axi-symmetric collimated wave 312 or beam from the paraboloid reflector 330 of the first set of dual offset reflectors 304. The first axis 326 may extend between the paraboloid 330 of the first set of dual offset reflectors 304 and the paraboloid 332 of the second set of dual offset reflectors 306.

The second set of dual offset reflectors 306 may also include a hyperboloid reflector 334 to produce the axi-symmetrical spherical wave 314 converted from the axi-symmetric collimated wave 312 by the second set of dual offset reflectors 306. The axi-symmetrical collimated wave or beam 312 being axi-symmetric about the first axis 326 permit the first set of dual offset reflectors 304 and the second set of dual offset reflectors 306 to be rotatable relative to one another without causing any distortion to the axi-symmetrical spherical wave 314. The spherical wave 314 may then be focused at the focus 316 of the high gain reflector system 318 without any distortion or loss of antenna efficiency that may be caused by rotating the first and second set of dual offset reflectors 304 and 306 to different rotational positions relative to one another about the first axis 326. A gimbal 336 or other mechanism may be provided to rotate one of the first or second set of dual offset reflectors 304 or 306 about the first axis 326. In another embodiment of the present invention, the hyperboloid reflector 328 and the hyperboloid reflector 334 may each be replaced by an ellipsoid reflector without affecting the principle of operation of the present invention.

Figure 1B:
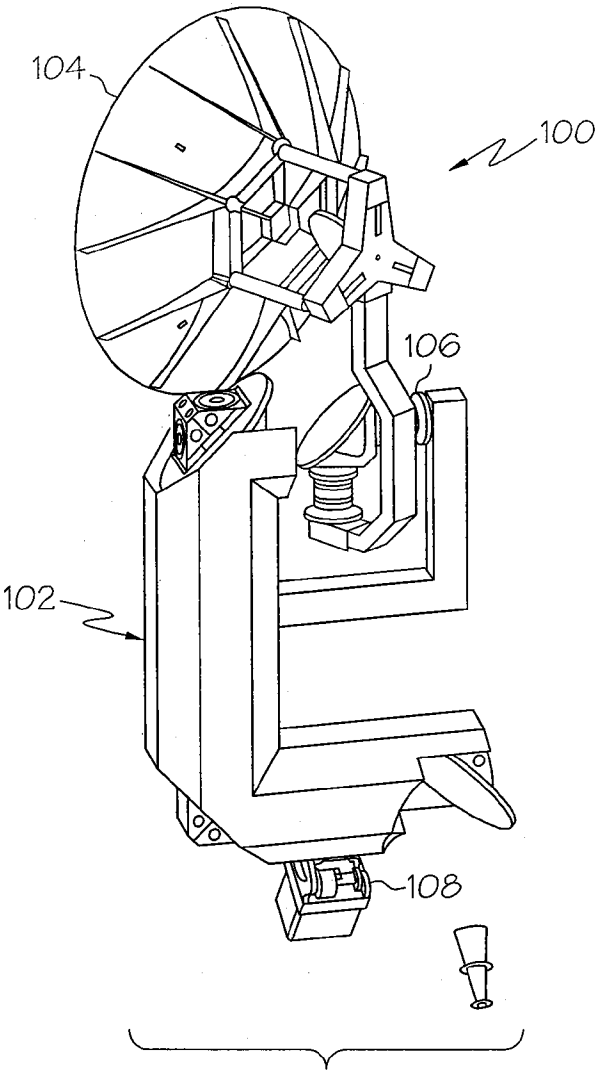
FIG. 1B (PRIOR ART)
FIGS. 1A and 1B are an illustration of a prior art moveable beam waveguide structure and antenna assembly with the antenna assembly being in different positions to show structural interference with a range of motion or field of regard of the antenna assembly.
Figure 1A:
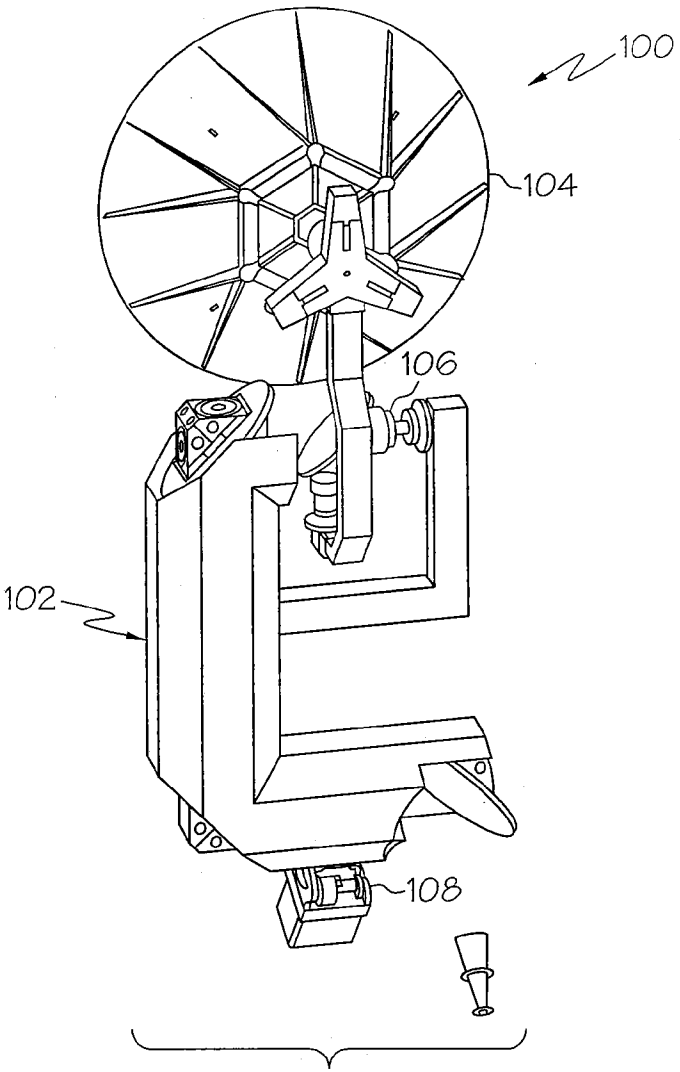
FIG. 1A (PRIOR ART)
Figure 2B:
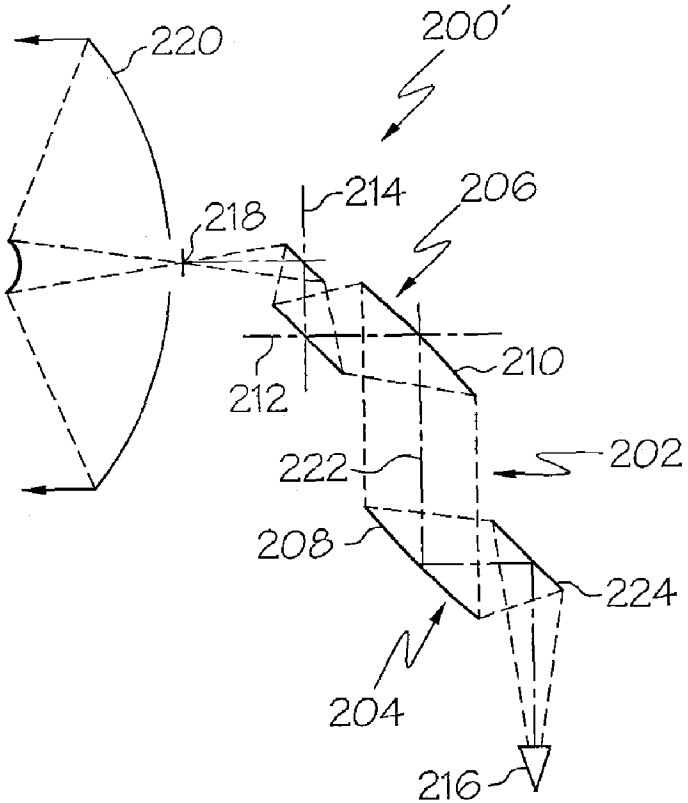
FIG. 2B (PRIOR ART)
FIG. 2B is an unconventional adaptation of the prior art beam waveguide of FIG. 2A.
Figure 2A:
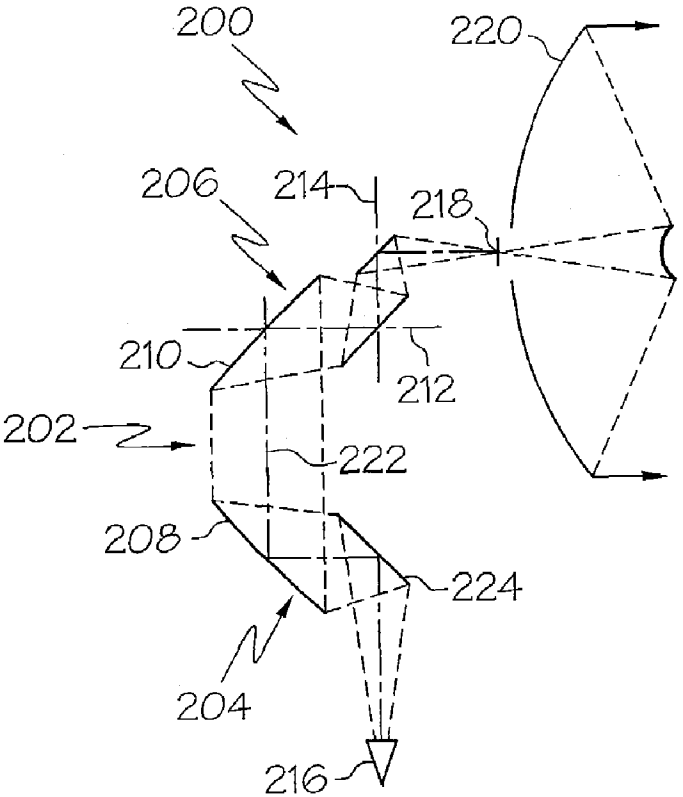
FIG. 2A (PRIOR ART)
FIG. 2A is an illustration of a prior art beam waveguide including a set of offset paraboloid reflectors.

When a geometry or configuration of a sub-reflector and a main reflector of an offset reflector system, such as offset reflector sets 304 and 306, is chosen such that the main reflector aperture fields are symmetric about the systems center axis, the reflector system may be said to satisfy the "Mizuguchi Condition." Accordingly, the first set of dual offset reflectors 304 and the second set of dual offset reflectors 306 as described above satisfy the Mizuguchi condition. The Mizuguchi condition dual reflector system including first and second dual offset reflector sets 304 and 306 produces an axi-symmetric aperture pattern from a main reflector 348 of the antenna system 300. The axi-symmetry allows rotation about the axis of the reflector system that is not possible with offset systems producing non axi-symmetric or asymmetric fields as in the prior art waveguides of FIGS. 1 and 2. The Mizuguchi condition is described in "Offset Gregorian Antenna," by Y. Mizuguchi, M. Akagawa, and H. Yokoi, Trans. IECE Japan, No. 3, Vol. J61-B, March 1978, pp. 166-173.

The axi-symmetric wave 314 is transmitted from the second set of dual offset reflectors 306 to the one or more reflectors 320 and 322 along a second axis 338. The reflectors 320 and 322 and the second set of dual offset reflectors 306 may be rotated relative to one another about the second axis 338 by a gimbal 340 or similar mechanism.

The reflectors 320 and 322 may also be rotated relative to one another about a third axis 342 by a third gimbal 344 or similar device.

The high gain reflector system 318 or antenna system may be an axi-symmetric Cassegrain reflector set including a shaped sub reflector 346 and a main reflector 348. The gimbal mechanisms 336, 340 and 344 may re-point the reflector system 318. The feed horn 308, dual offset reflector sets 304 and 306, reflectors 320 and 322 and gimbal mechanisms 336, 340 and 344 may be contained in or mounted to a support structure 350 or that may include or form the beam waveguide 302. The support structure 350 may be mounted to a vehicle 352. The vehicle 352 may be a spacecraft, satellite, aircraft, terrestrial vehicle, watercraft or other type vehicle.

The spherical wave propagating from point 316 may have a radiation pattern symmetrical about a central radiation axis 354 provided that a feed horn pattern or wave 310 is also symmetrical about a boresight radiation axis 356. This may produce a high gain, low cross polarization collimated beam 358 from the aperture of the Cassegrain system or high gain reflector system 318 that does not change as the system is gimbaled, rotated or positioned in any combination of angles for axes 326, 338 and 342. This feature of this embodiment of the present invention permits an extra degree of freedom of rotation between the paraboloid reflectors 330 and 332, enabling the beam waveguide 302 or antenna system 300 a larger potential field of view, magnification of the feed gain, and a more compact geometry. In addition, because the radiation from the paraboloid reflectors 330 and 332 is axi-symmetric, the focal characteristics of the offset reflector sets 304 and 306 do not have to be identical. This characteristic or feature of this embodiment of the present invention is advantageous in that it allows more flexibility in the feed horn size and the distance from the feed horn to the first paraboloid. This allows a designer to effectively magnify the size of the feed in the imaging system without breaking the symmetry of the feed image pattern.

While the exemplary embodiment of the antenna system 300 of the present invention has been described with respect to transmitting an electromagnetic signal, wave or beam, those skilled in the art will recognize that the system 300 could equally receive an electromagnetic signal wave or beam. Similar to a transmitted beam or wave, the beam or wave received at the feed horn 308 would not be affected or distorted by any rotation of the reflectors about axes 326, 338 and 342.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," and "includes" and/or "including" when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A beam waveguide, comprising:

a first set of dual offset reflectors;

a second set of dual offset reflectors, wherein the first set of dual offset reflectors and the second set of dual offset reflectors each include reflector geometries to produce a radiation pattern that is symmetric about a first axis between the first and second set of dual offset reflectors and to produce an axi-symmetric beam from the second set of dual offset reflectors that is unaffected by any rotation of the first and second set of dual offset reflectors relative to one another about the first axis;

a waveguide structure containing the first and second set of dual offset reflectors;

a first reflector to transmit or receive a beam along a second axis from the second set of dual offset reflectors, wherein the first flat reflector is rotatable relative to the second set of dual offset reflectors about the second axis;

a second reflector to transmit or receive the beam from the first reflector along a third axis and wherein the second reflector is rotatable relative to the first reflector about a third axis;

a first gimbal associated with the first axis for rotating the second set of dual offset reflectors to any angle relative to the first set of dual offset reflectors;

a second gimbal associated with the second axis for rotating the first reflector to any angle relative to the second set of dual offset reflectors; and a third gimbal associated with the third axis to rotate the second reflector to any angle relative to the first reflector, the first gimbal, the second gimbal and the third gimbal being able to rotate the associated reflectors to any angle about the first axis, the second axis and the third axis to prevent any keyhole condition and to avoid any interference with the waveguide structure.

2. The beam waveguide of claim 1, wherein the first set of dual offset reflectors comprises:

one of a hyperboloid reflector or an ellipsoid reflector to receive a spherical wave; and a paraboloid reflector to transmit a axi-symmetric collimated wave, that is axi-symmetrical about the first axis, to the second set of dual offset reflectors along the first axis, the first set of dual offset reflectors converting the received spherical wave to the axi-symmetric collimated wave, and wherein the second set of dual offset reflectors comprises:

a paraboloid reflector to receive the axi-symmetric collimated wave from the paraboloid reflector of the first set of dual offset reflectors, the first axis extending between the paraboloid of the first set of dual offset reflectors and the paraboloid of the second set of dual offset reflectors; and one of a hyperboloid reflector or an ellipsoid reflector to produce an axi-symmetric spherical wave converted from the axi-symmetric collimated wave by the second set of dual offset reflectors.

3. The beam waveguide of claim 1, wherein the first set of dual offset reflectors and the second set of dual offset reflectors are rotatable relative to one another about the first axis without causing distortion to the axi-symmetrical spherical wave from the second set of dual offset reflectors.

4. The beam waveguide of claim 1, wherein the first set of dual offset reflectors and the second set of dual offset reflectors satisfy a Mizuguchi condition.

5. The beam waveguide of claim 1, wherein the reflector geometries of the first set of dual offset reflectors and the second set of dual offset reflectors are adapted to permit rotation of the first and second dual offset reflectors relative to one another about the first axis without causing distortion of an output beam and loss in antenna efficiency.

6. The beam waveguide of claim 1, wherein the first and second set of dual offset reflectors each comprise a different focal characteristic.

7. The beam waveguide of claim 1, wherein the first and second set of dual offset reflectors and the at least one reflector are adapted to produce a collimated beam from an aperture of an axi-symmetric Cassegrain reflector set that remains unchanged in response to any combination of rotational positions of the reflectors about the first, second and third axes to provide an unobstructed field of regard.

8. The beam waveguide of claim 1, wherein the first gimbal rotates the second gimbal, the third gimbal, the second set of dual offset reflectors and the first and second flat reflectors, and the second gimbal rotates the third gimbal and the first and second flat reflectors.

9. A beam waveguide, comprising:

a first set of reflectors for receiving a spherical wave and collimating the wave axi-symmetrically about a first axis;

a second set of reflectors for receiving the axi-symmetric collimated wave transmitted along the first axis from the first set of reflectors, the second set of reflectors being adapted to convert the collimated wave back to an axi-symmetric spherical wave axi-symmetric about a second axis;

a waveguide structure containing the first and second set of reflectors;

a first reflector to transmit or receive a beam along a second axis from the second set of reflectors, wherein the first reflector is rotatable relative to the second set of reflectors about the second axis;

a second reflector to transmit or receive the beam from the first reflector along a third axis and wherein the second reflector is rotatable relative to the first reflector about a third axis;

a first gimbal associated with the first axis for rotating the second set of reflectors to any angle relative to the first set of dual reflectors;

a second gimbal associated with the second axis for rotating the first reflector to any angle relative to the second set of reflectors; and a third gimbal associated with the third axis to rotate the second flat reflector to any angle relative to the first reflector, the first gimbal, the second gimbal and the third gimbal being able to rotate the associated reflectors to any angle about the first axis, the second axis and the third axis to prevent any keyhole condition and to avoid any interference with the waveguide structure.

10. The beam waveguide of claim 9, wherein one of the first set of reflectors and the second set of reflectors comprises reflector component geometries that permit the first and second set of reflectors to be rotated relative to one another about the first axis without affecting the axi-symmetric spherical wave.

11. The beam waveguide of claim 9, wherein the first set of reflectors comprises:

one of a hyperboloid reflector or an ellipsoid reflector to receive the spherical wave; and a paraboloid reflector to transmit the axi-symmetric collimated wave along the first axis to the second set of dual offset reflectors, and wherein the second set of reflectors comprises:

a paraboloid reflector to receive the axi-symmetric collimated wave from the paraboloid of the first set of dual offset reflectors; and one of a hyperboloid reflector or an ellipsoid reflector to transmit the axi symmetric spherical wave to the at least one reflector.

12. The beam waveguide of claim 9, wherein the third reflector is rotatable about a third axis and wherein the first and second set of reflectors and the first reflector are rotatable to any angular position about the first, second and third axes without affecting the axi-symmetrical spherical wave directed to the antenna.

13. The beam waveguide of claim 9, wherein the first set of reflectors and the second set of reflectors each comprise a dual offset reflector set that satisfy a Mizuguchi condition.

14. An antenna system, further comprising:

an antenna for transmitting an output wave;

a feed horn;

a first set of reflectors for receiving and converting a spherical wave from the feed horn to a collimated wave;

a second set of reflectors for receiving the collimated wave along a first axis from the first set of reflectors and converting the collimated wave to another spherical wave for transmission to the antenna, wherein at least one of the first and second set of reflectors are rotatable about the first axis and include reflector components to permit rotation about the first axis without affecting the output wave from the antenna;

a waveguide structure containing the first and second set of reflectors;

a first reflector to transmit or receive a beam along a second axis from the second set of reflectors, wherein the first reflector is rotatable relative to the second set of reflectors about the second axis;

a second reflector to transmit or receive the beam from the first reflector along a third axis and wherein the second reflector is rotatable relative to the first reflector about a third axis;

a first gimbal associated with the first axis for rotating the second set of reflectors to any angle relative to the first set of reflectors;

a second gimbal associated with the second axis for rotating the first reflector to any angle relative to the second set of reflectors; and a third gimbal associated with the third axis to rotated the second reflector to any angle relative to the first reflector, the first gimbal, the second gimbal and the third gimbal being able to rotate the associated reflectors to any angle about the first axis, the second axis and the third axis to prevent any keyhole condition and to avoid any interference with the waveguide structure.

15. The antenna system of claim 14, wherein the first set of reflectors comprises a first set of dual offset reflectors for receiving and converting the spherical wave to an axi-symmetric collimated wave axi-symmetrical about the first axis, and the second set of reflectors comprises a second set of dual offset reflectors for receiving and converting the axi-symmetric collimated wave to an axi-symmetric spherical wave axi-symmetrical about the second axis.

16. The antenna system of claim 14, wherein the first and second set of reflectors satisfy a Mizuguchi condition.

17. The antenna system of claim 14, wherein the first set of reflectors comprises:

one of a hyperboloid reflector or an ellipsoid reflector to receive the spherical wave; and a paraboloid reflector to transmit an axi-symmetric collimated wave along the first axis to the second set of reflectors, and wherein the second set of reflectors comprises:

a paraboloid reflector to receive the axi-symmetric collimated wave from the paraboloid of the first set of dual offset reflectors; and one of a hyperboloid reflector or an ellipsoid reflector to transmit an axi-symmetric spherical wave converted from the axi-symmetric collimated wave to the antenna, wherein the axi-symmetric spherical wave is symmetric about a second axis.

18. The antenna system of claim 14, wherein the first and second set of reflectors and the first and second reflectors are configured to produce a beam from the antenna that is unchanged in response to any combination of rotational positions of the reflectors about the first, second and third axes to provide an unobstructed field of regard.

19. The antenna system of claim 14, wherein the antenna comprise an axi-symmetric Cassegrain reflector set and wherein the first and second set of reflectors comprise reflector elements to produce a collimated axi-symmetric beam from an aperture of the antenna that remains unchanged and undistorted in response to any rotation about the first axis.

20. The antenna system of claim 14, further comprising a waveguide, wherein at least the first and second set of reflectors are mounted in the waveguide, and wherein the waveguide, feed horn and antenna are mountable to a vehicle.

21. The antenna system of claim 14, wherein the antenna is adapted to receive a wave and the first and second set of reflectors are adapted to transmit the wave to the feed horn without affecting the wave regardless of a rotated position of the first and second set of reflectors about the first axis.

22. A method to provide a substantially complete field of regard in a beam waveguide without distortion in an output beam, comprising:

producing a collimated wave from a spherical wave for transmission along a first axis, within a waveguide structure, wherein the collimated wave is axi-symmetric to the first axis; and producing an axi-symmetric spherical wave from the collimated axi-symmetric wave for transmission along a second axis within the waveguide structure, wherein the collimated wave remains axi-symmetrical and distortionless regardless of any rotation of reflector elements about the first and second axis; and providing a third axis of rotation to provide the substantially complete field of regard, wherein the axi-symmetrical spherical wave remains unchanged and distortionless in response to the beam waveguide being any rotation position about the first, second and third axes to prevent any keyhole condition and to avoid any interference with the waveguide structure.

23. The method of claim 22, wherein producing the collimated wave from the spherical wave-and producing the axi-symmetrical spherical wave from the collimated axi-symmetric wave comprising providing a pair of Mizuguchi condition dual offset reflector sets.

24. The beam waveguide of claim 8, further comprising a feed, wherein the feed and a first and second reflector of the first set of dual offset reflectors are fixedly mounted relative to one another.

* * * * *